US010582795B1

(12) United States Patent
Rawls

(10) Patent No.: US 10,582,795 B1
(45) Date of Patent: Mar. 10, 2020

(54) PORTABLE SECURE MAILBOX SYSTEM

(71) Applicant: Kevin Rawls, Columbia, MS (US)

(72) Inventor: Kevin Rawls, Columbia, MS (US)

( * ) Notice: Subject to any disclaimer, the term of this patent is extended or adjusted under 35 U.S.C. 154(b) by 0 days.

(21) Appl. No.: 16/373,525

(22) Filed: Apr. 2, 2019

(51) Int. Cl.
*A47G 29/12* (2006.01)
*A47G 29/122* (2006.01)

(52) U.S. Cl.
CPC ..... *A47G 29/1216* (2013.01); *A47G 29/122* (2013.01); *A47G 29/1214* (2013.01)

(58) Field of Classification Search
CPC ..... A47G 29/1216; A47G 29/1214; A47G 29/122; F16M 11/42; F16M 2200/08
USPC ..... 232/38, 39, 17, 34–36; 248/129, 346.2
See application file for complete search history.

(56) References Cited

U.S. PATENT DOCUMENTS 2,310,835 A 2/1943 Burleigh et al.
2,995,330 A 8/1961 Alms
4,588,123 A * 5/1986 Plew ..... A47G 29/1216 232/39
4,852,847 A 8/1989 Pagel
5,022,618 A 6/1991 Barrett et al.
5,029,783 A 7/1991 Alvarez
5,096,115 A * 3/1992 Hassan ..... A47G 29/1209 232/17
5,207,377 A * 5/1993 Brecht ..... A47G 29/1209 232/17
6,318,627 B1 * 11/2001 Koebbe ..... G07F 9/10 221/284
6,513,284 B1 * 2/2003 Sandlin ..... A01G 9/022 232/39
7,140,581 B1 * 11/2006 White ..... E04H 12/2246 248/129
7,464,945 B2 * 12/2008 Humphries ..... B65F 1/006 248/128
2004/0222335 A1 * 11/2004 Panek, Jr. ..... B65F 1/1468 248/129

(Continued)

FOREIGN PATENT DOCUMENTS

WO WO 2007/097683 8/2007

*Primary Examiner* — William L Miller
(74) *Attorney, Agent, or Firm* — Keaty Law Firm LLC

(57) ABSTRACT

A portable secure mailbox system providing a mail container unit having a container-unit protrusion, a container-unit door, and a container-unit partition, a base anchor unit allowing filling with anchoring material such as water or sand, and having a base-unit recess, base-unit wheels, a base-unit removable plug, and a base-unit foot, at least one bolt and nut to secure the mail container unit to the base anchor unit, a powered sensor-transmitter unit to detect activity and transmit notifications, an optional solar array to recharge the powered sensor-transmitter unit, and an optional ornamental casing. The portable secure mailbox system provides a mailbox and support base that can be easily transported and put in place, when empty, and, after the base anchor unit is filled with anchoring material such as water or sand, and the mail container unit is mounted upon the base anchor unit, provides a stable secure mailbox that can detect activity and transmit notifications. The portable secure mailbox system also provides a mailbox and support base that yield somewhat if struck by a vehicle, such that the mailbox remains functional and damage to the vehicle and driver is reduced.

20 Claims, 9 Drawing Sheets

(56) References Cited

U.S. PATENT DOCUMENTS

| | | | | |
|---|---|---|---|---|
| 2008/0067227 | A1* | 3/2008 | Poss | A47G 29/22<br>232/17 |
| 2009/0278001 | A1* | 11/2009 | Sherburne | A01G 9/02<br>248/146 |
| 2015/0108209 | A1* | 4/2015 | Cho | A47G 29/1212<br>232/34 |
| 2017/0262800 | A1* | 9/2017 | Dorpfeld | G06Q 10/0833 |

* cited by examiner

PORTABLE SECURE MAILBOX SYSTEM

BACKGROUND OF THE INVENTION

This invention provides a portable secure mailbox system that can be easily transported and put in place, without digging or other site preparation, but which provides a stable secure mailbox after installation.

Many communities use mailboxes that are located very near the street or road, such that a mail carrier can reach the mailbox while remaining seated in a vehicle. Presently, such mailboxes are mounted upon a post sunk into a hole dug into the ground and surrounded by concrete, or upon a brick or masonry pedestal. Those methods require the transportation of and working with heavy materials and mixing concrete or mortar.

In circumstances such as the setting up, taking down, and transporting of temporary buildings, the present methods of installing mailboxes are too cumbersome and expensive.

Mailboxes are frequently vandalized and stolen from. Roadside mailboxes tend to be located far enough away from a dwelling or building such that any motion-detecting security or recording system will not be triggered by activity at the mailbox, and therefore such activity is unlikely to be photographically recorded by the security system.

Roadside mailboxes are frequently struck by vehicles. Mailboxes installed using the present methods, when struck, are likely to be damaged beyond the point of being useable. Posts and pedestals are likely to be so badly broken and damaged that they must be completely replaced. Also, a vehicle striking such a heavy and fixed-in-place mailbox is likely to suffer a large amount of damage, and the vehicle's occupants are likely to be injured. Presently installed mailboxes do not function like modern-day highway barriers that are often filled with water or sand and are made to be firmly fixed in place, but yet will yield somewhat when struck by a vehicle, dampening some of the force.

What is therefore needed is a mailbox and support base that can be easily transported and put in place, without digging or other site preparation, but which provides a stable secure mailbox after installation.

U.S. Pat. No. 2,995,330 discloses a portable stand with rural mailbox accommodating means. The cited disclosure comprises supports and has reference, specifically speaking, to a portable stand that, as is generally the situation, is placed for use along the margin of a road or highway and that is expressly but not necessarily designed and adapted to mount and erect a rural mailbox for practical and available incoming and outgoing mail service.

U.S. Pat. No. 5,022,618 discloses a mailbox support apparatus. The cited disclosure comprises a mailbox support apparatus having a mailbox mounting plate attached to a hollow post member includes aground mount stake driving into the ground and received within the hollow post member.

U.S. Pat. No. 5,029,783 discloses a flexible mailbox stand. The cited disclosure comprises a stand for mailboxes that provides an elongated structural assembly that includes an upper section that is rigidly mounted to a mailbox and a lower section that is rigidly mounted to a fixed location. The two sections are coaxially aligned next to each other and urged towards each other through the action of a spring member that is pre-stretched inside the inner and lower sections. The larger the deflection of the upper section with respect to the at rest coaxial alignment with the lower section, the larger the recovering force that is created perpendicular to the at rest coaxial alignment.

U.S. Pat. No. 4,852,847 discloses a releasable mailbox mounting apparatus. The cited disclosure comprises a mailbox post mounting apparatus that includes a post bracket and a mailbox bracket affixed respectively to the ground support post and the mailbox respectively. The brackets include abutting plate-like members having aligned openings with the mailbox in the mail receiving position. A break away pin is secured within the openings to lock the mailbox in place for receiving the nail. If the mailbox is struck by a vehicle, the pin releases or breaks away and releases the mailbox and its support from the post bracket and the post. In one unit, a post-bracket has a post securement plate with an integral lock plate extending outwardly and vertically at the same releasable angular orientation as the post plate. A releasable pin passes through aligned openings to lock the brackets to each other. In another unit, the post bracket and the mailbox bracket may be opposed and telescoped U-shaped channels having vertical pivot bolt units to establish pivotal support. The overlapping channel sides include the pin openings receiving cotter pin that releasably locks the mailbox in place. The mailbox bracket may include a threaded end member having a horizontal axis for receiving a corresponding threaded pipe to which the mailbox is mounted.

U.S. Pat. No. 2,310,835 discloses a portable mail holder. The cited disclosure comprises improvements in clamps for the insertion of and the holding together therebetween of letterheads, billheads, noteheads, letters and other papers in a form convenient to carry or file so as to readily permit each item to be inserted between the clamping members or separately removed therefrom without disturbing the remainder of the items.

International publication WO 2007/097683 discloses a mailbox comprising a container with sides, a top part and a bottom part. The container is constructed as a first container portion and a second container portion where the first container portion is so constructed that its main part may be contained inside the second container portion. The second container portion is accordingly so constructed that it can contain the main part of the first container portion. The first container portion is provided with a first assembly flange that is intended to cooperate with a second assembly flange on the second container portion and that the mailbox, after having been assembled by means of the said first and second assembly flanges, can be provided with a partition wall that divides the first container portion from the second container portion.

SUMMARY OF THE INVENTION

This invention provides a portable secure mailbox system providing a mail container unit having a container-unit protrusion, a container-unit door, and a container-unit partition, a base anchor unit allowing filling with anchoring material such as water or sand, and having a base-unit recess, base-unit wheels, a base-unit removable plug, and a base-unit foot, at least one bolt and nut to secure the mail container unit to the base anchor unit, a powered sensor-transmitter unit to detect activity and transmit notifications, an optional solar array to recharge the powered sensor-transmitter unit, and an optional ornamental casing.

The portable secure mailbox system provides a mailbox and support base that can be easily transported and put in place, when empty, and, after the base anchor unit is filled with anchoring material such as water or sand, and the mail container unit is mounted upon the base anchor unit, provides a stable secure mailbox that can detect activity and transmit notifications. The portable secure mailbox system also provides a mailbox and support base that yield somewhat if struck by a vehicle, such that the mailbox remains functional and damage to the vehicle and driver is reduced.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
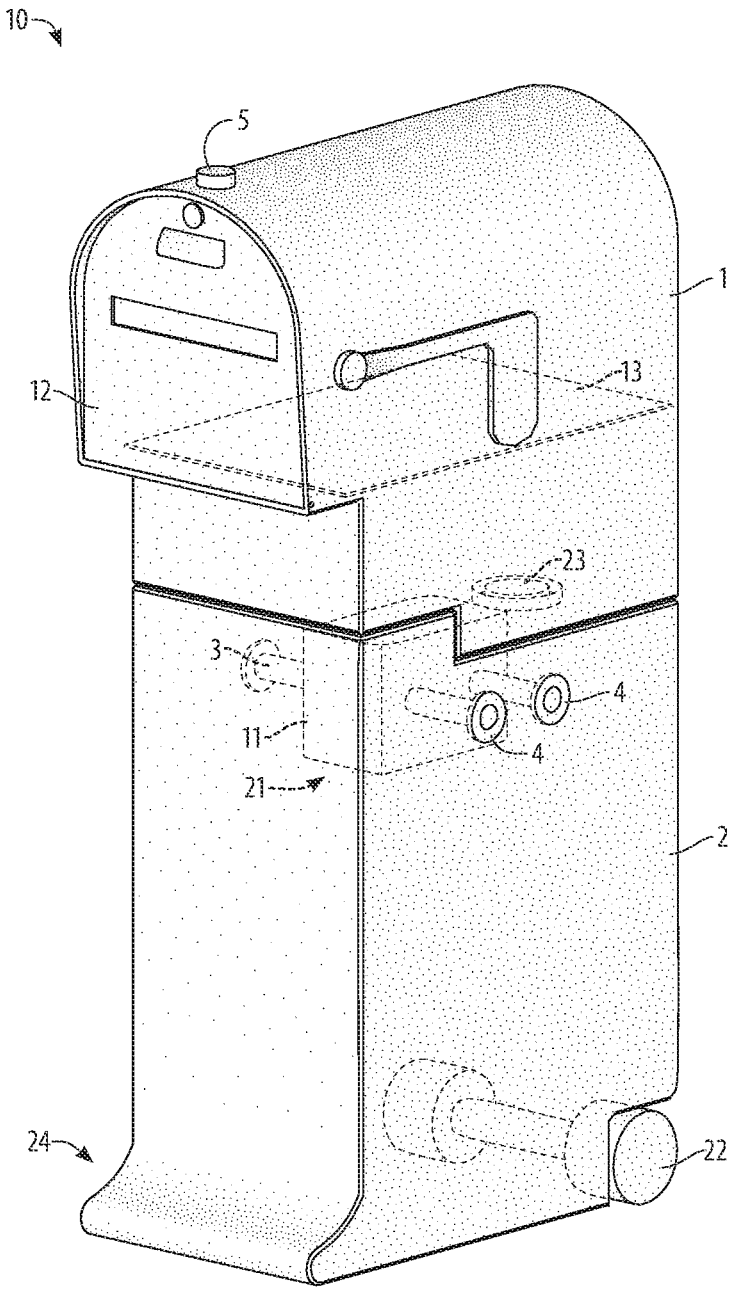
FIG. 1 is a dimetric-projection hidden-line view of the portable secure mailbox system of the invention.

Referring to FIG. 1, the portable secure mailbox system 10 provides a mail container unit 1 and a base anchor unit 2 that, in use, are securely connected together with a container-unit protrusion 11 fitting into a base-unit recess 21. The container-unit protrusion 11 and the base-unit recess 21 have corresponding side-to-side openings or holes to accommodate one or more bolts 3 secured with nuts 4.

The mail container unit 1 has an interior void or empty area for containing mail. A container-unit door 12 provides a secure closure. A container-unit partition 13 can be closed to segregate a portion of the interior void or opened to allow for containing more mail or larger parcels.

A powered sensor-transmitter unit 5 is mounted at the top front of the mail container unit 1, as treated below.

The base anchor unit 2 provides a set of base-unit wheels 22 allowing the unit to be rolled when the unit is tilted back, which is helpful when moving and placing the mailbox during installation.

The base anchor unit 2 also has an interior empty or void space that can hold an anchoring material that can be a fluid such as water or a granular material such as sand or gravel. Often, the most convenient anchoring material will be water from a garden hose. A base-unit removable plug 23 is provided at the top of the base anchor unit 2 to put in or take out the anchoring material.

The base anchor unit 2 also has a base-unit foot 24 at the front bottom portion that both increases the bottom surface area and acts as a bumper so that, for instance, a wheeled vehicle will be discouraged from approaching to close to the mailbox and possibly damaging it.

Figure 2:
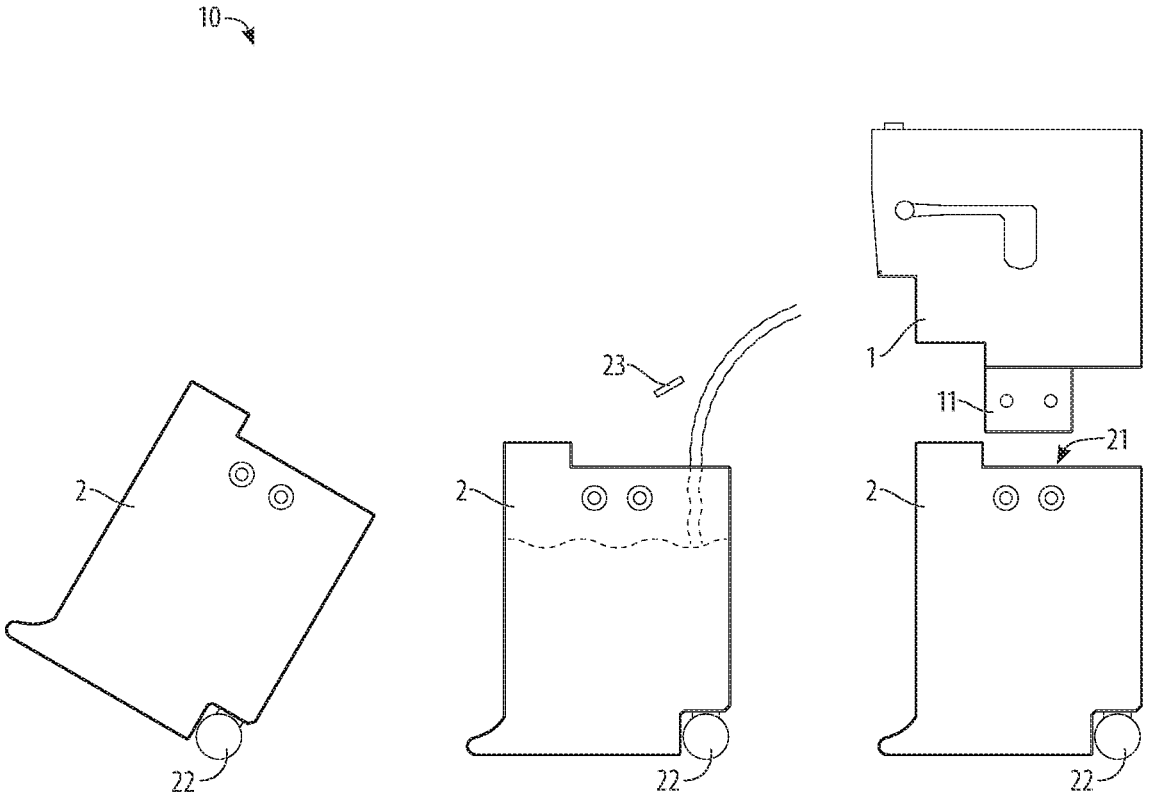
FIG. 2 is a schematic view of installation of the portable secure mailbox system of the invention.

Referring to FIG. 2, during installation the empty and therefore lighter base anchor unit 2 can be rolled to the mailbox site on the base-unit wheels 2. Once in place, the base anchor unit 2 is filled, through the base-unit removable plug 23, with an anchoring material such as water, which makes the base anchor unit 2 now heavy and stable. The mail container unit 1 is then mounted upon the base anchor unit 2, with the container-unit protrusion 11 fitting into the base-unit recess 21.

Figure 3:
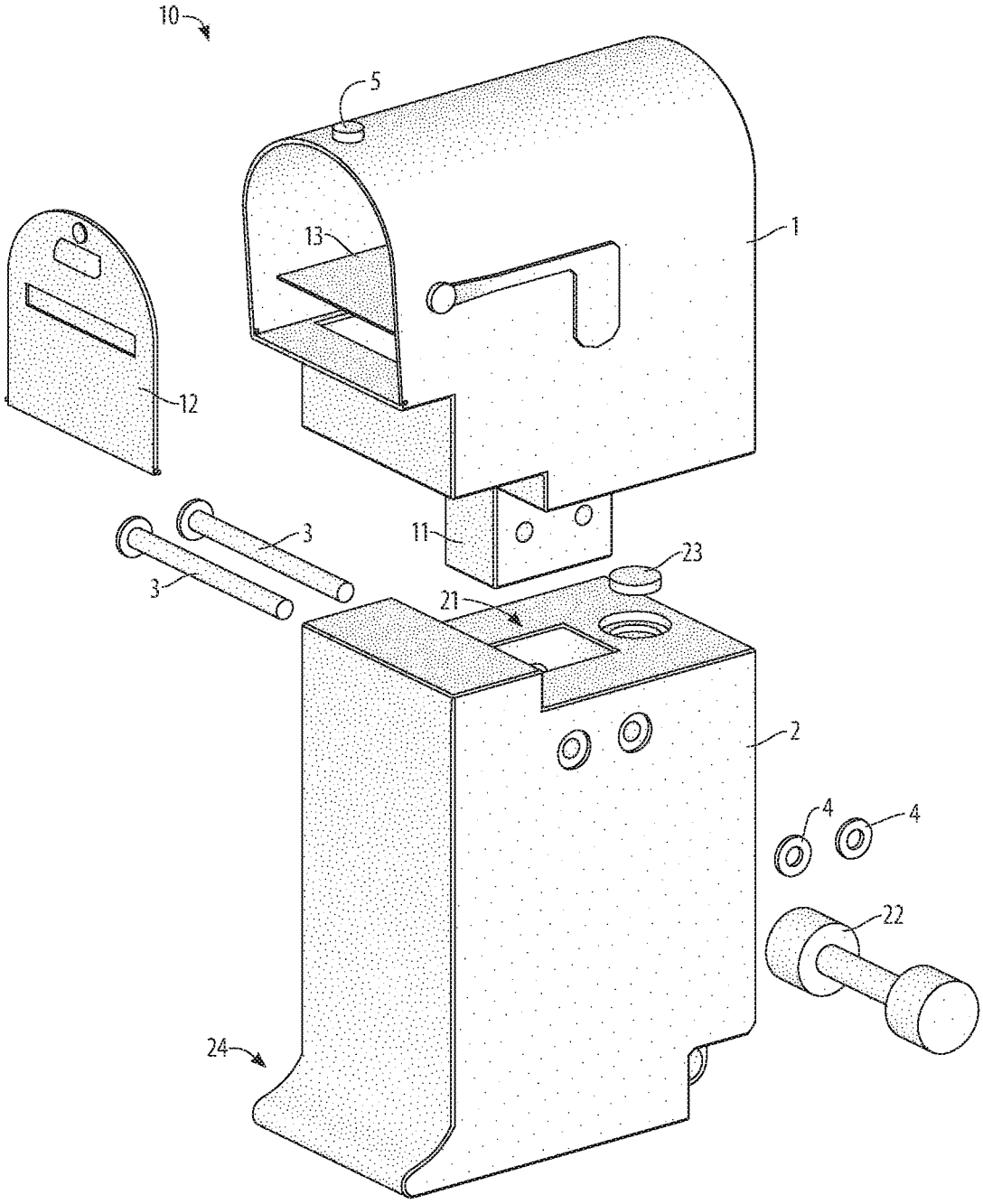
FIG. 3 is an exploded view of the portable secure mailbox system of the invention.
Figure 4:
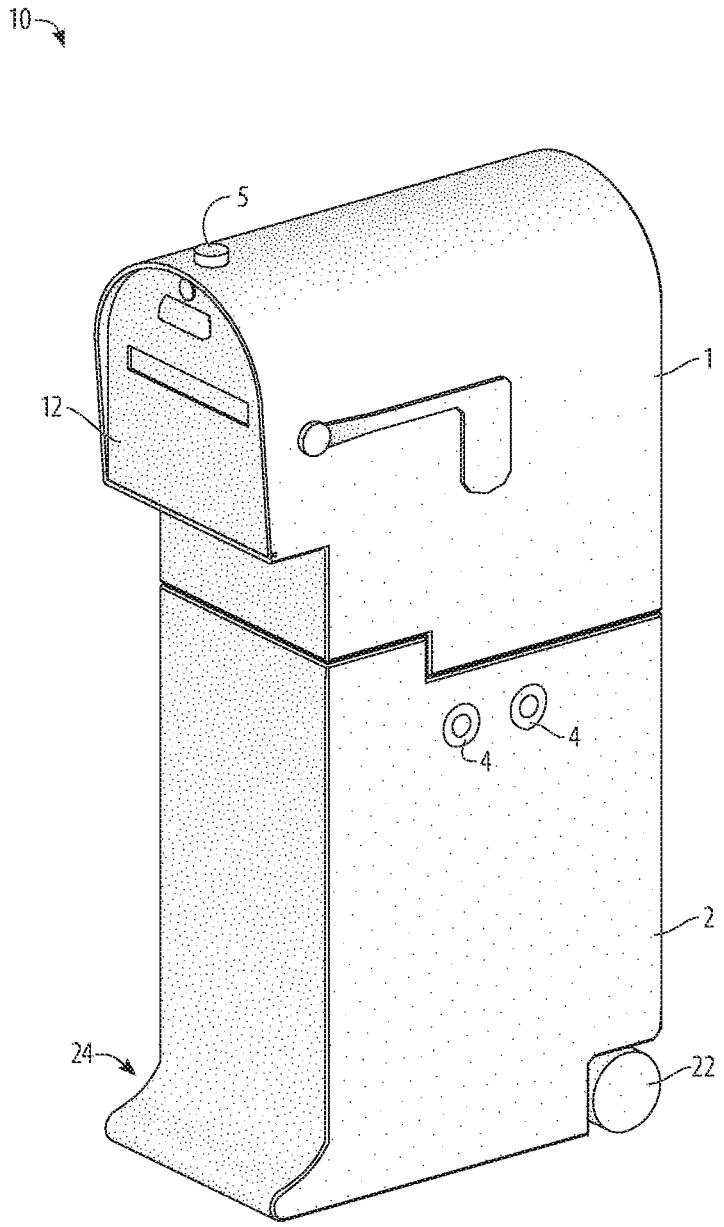
FIG. 4 is a dimetric-projection view of the portable secure mailbox system of the invention.

Referring to FIG. 3 and FIG. 4, the portable secure mailbox system 10 is shown in exploded and assembled views.

Figure 5:
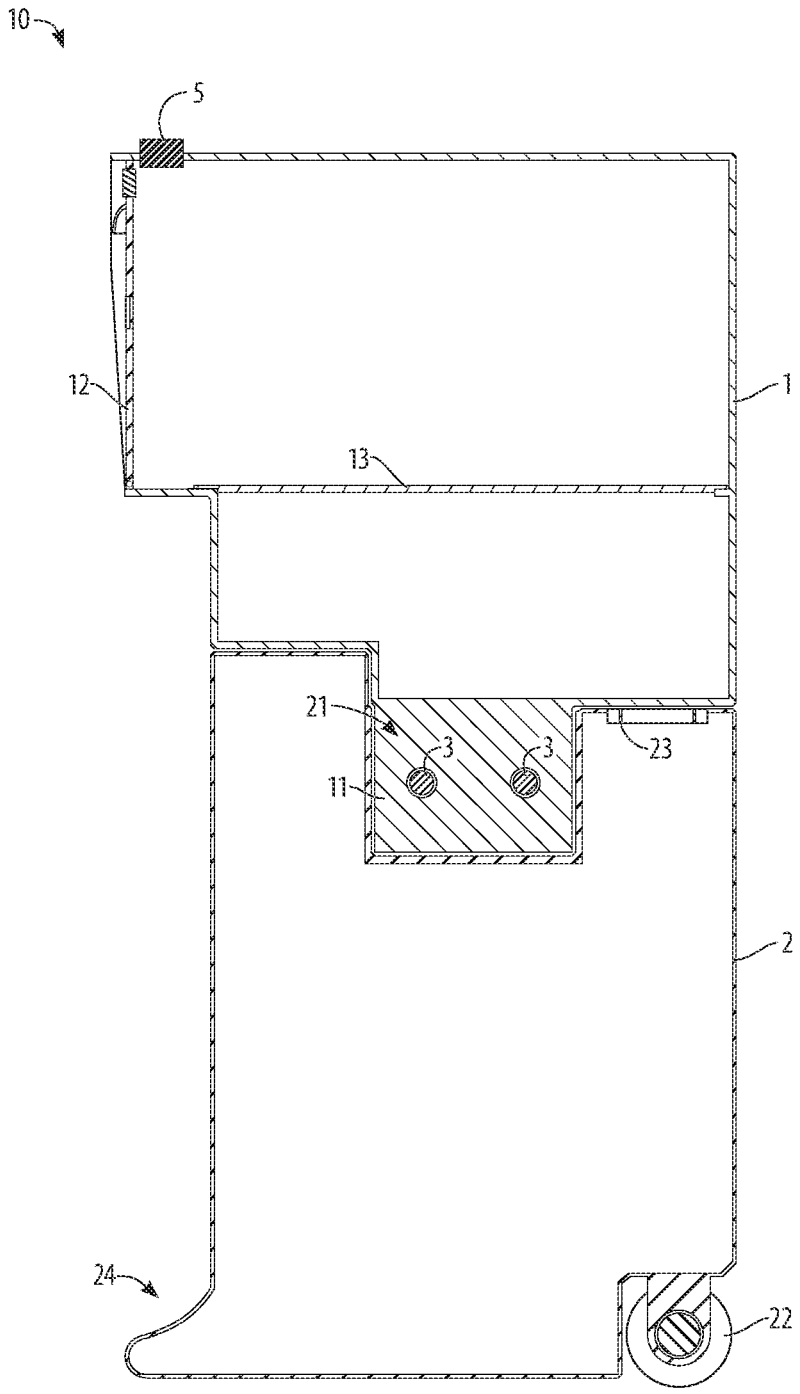
FIG. 5 is a section view of the portable secure mailbox system of the invention.

Referring to FIG. 5, the portable secure mailbox system 10 is shown in section view, showing the large amounts of internal void space in both the mail container unit 1, for holding mail, and the base anchor unit 2, for holding anchoring material such as water. Also shown is the powered sensor-transmitter unit 5 mounted with a lower portion extending inside the mail container unit 1 for detecting the status inside the mailbox, and with an upper portion extending above the mail container unit 1 for efficient transmission of notifications about the status inside the mailbox.

Figure 6:
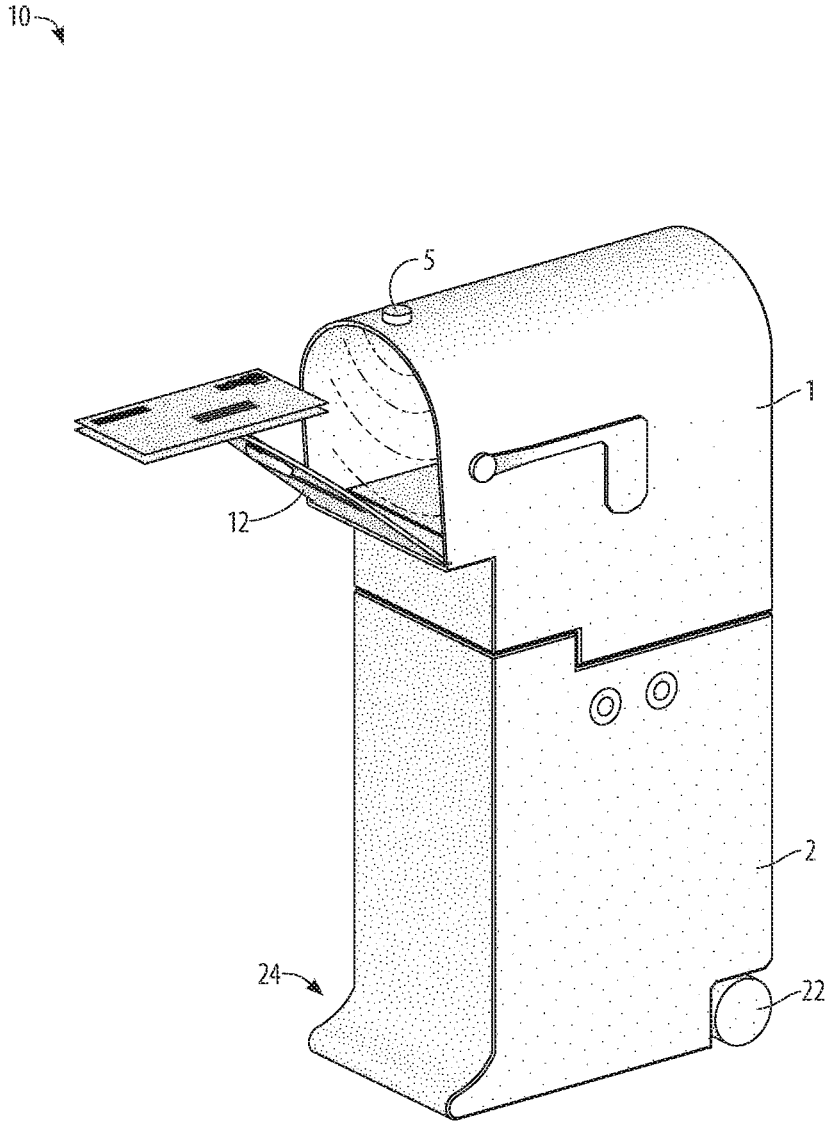
FIG. 6 is a schematic view of the portable secure mailbox system of the invention in use, in a sensing state.
Figure 7:
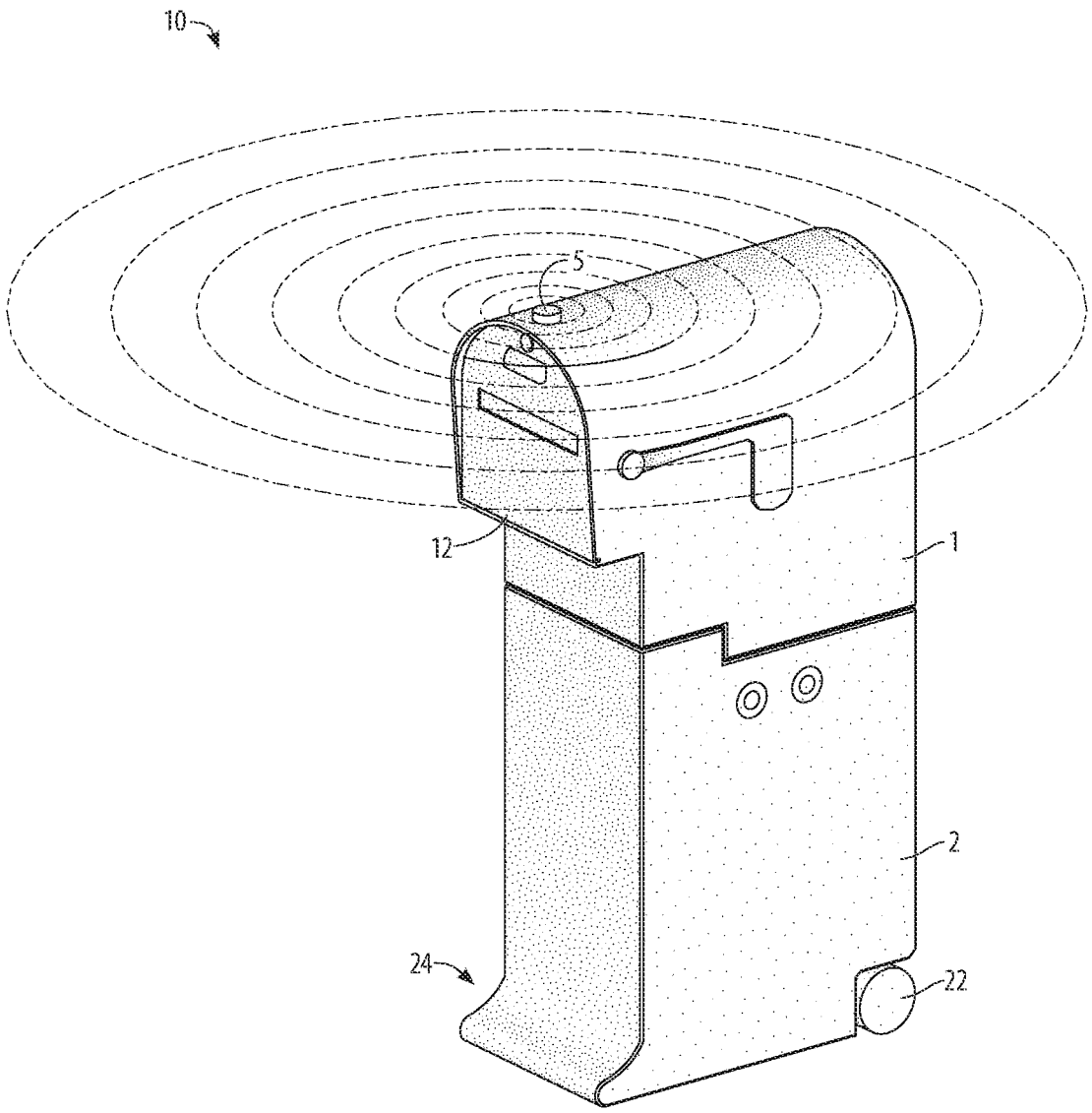
FIG. 7 is a schematic view of the portable secure mailbox system of the invention in use, in a transmitting state.

Referring to FIG. 6 and FIG. 7, the powered sensor-transmitter unit 5, which is powered by means such as a rechargeable battery or a capacitor, detects the status inside the mailbox, including any opening and closing of the container-unit door and any placing things into or taking things out of the mailbox. This detection can be made with one or more known and available sensors such as motion sensors and proximity sensors. The powered sensor-transmitter unit 5 also wirelessly transmits notifications regarding the status of the mailbox, including the opening or closing of the door and the placement, removal, or presence of mail. This wireless transmission can be made using known and available equipment and protocols, including the Internet of Things or LoRa protocols. The powered sensor-transmitter unit 5 can therefore function as a motion detector for triggering such things as a security system to make photographic recordings during activity at the mailbox.

Figure 8:
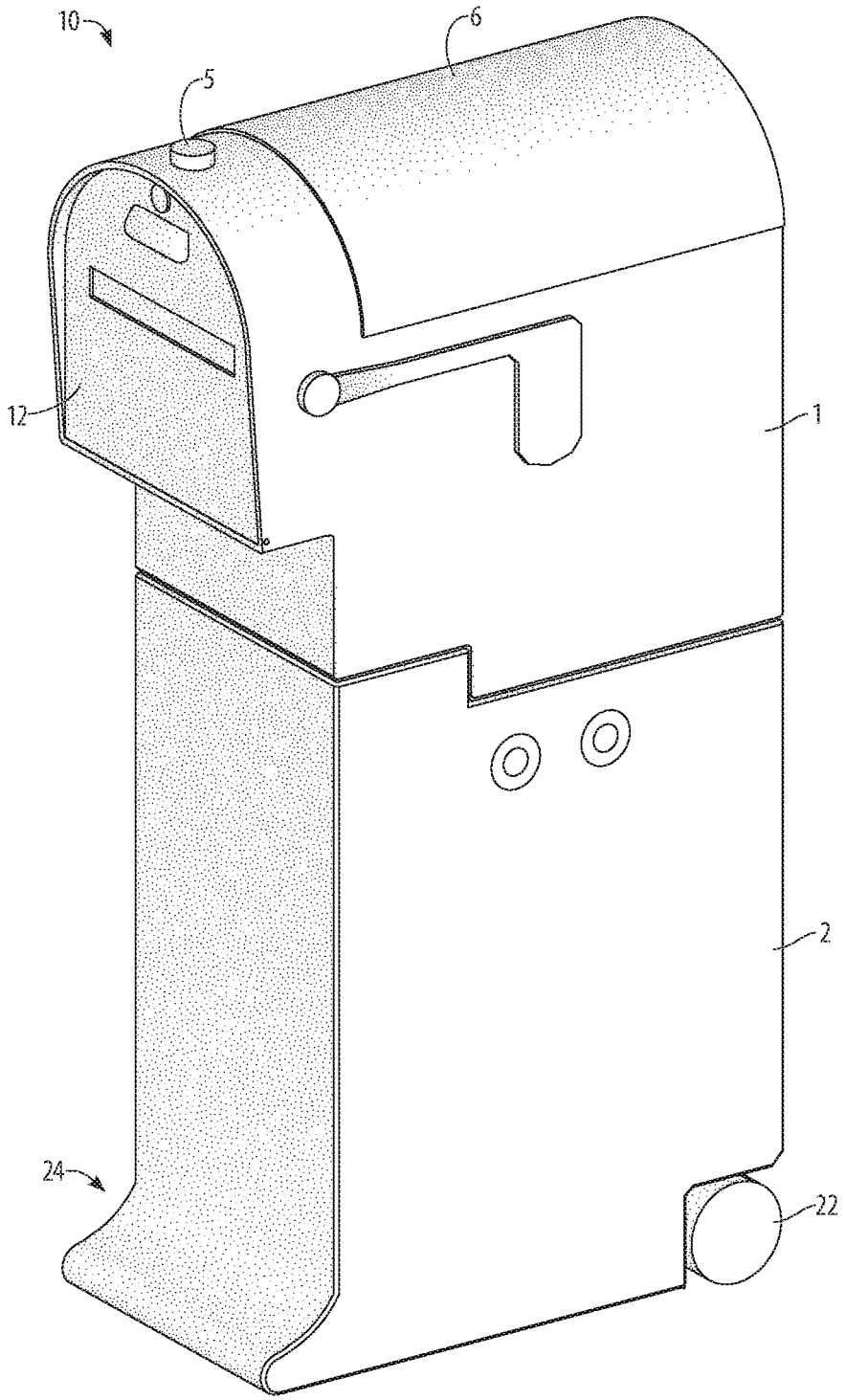
FIG. 8 is a dimetric-projection view of a solar-array embodiment of the portable secure mailbox system of the invention.

Referring to FIG. 8, an embodiment of the portable secure mailbox system 10 provides a solar array 6, of the kind known and available, for keeping the battery or capacitor of the powered sensor-transmitter unit 5 charged.

Figure 9:
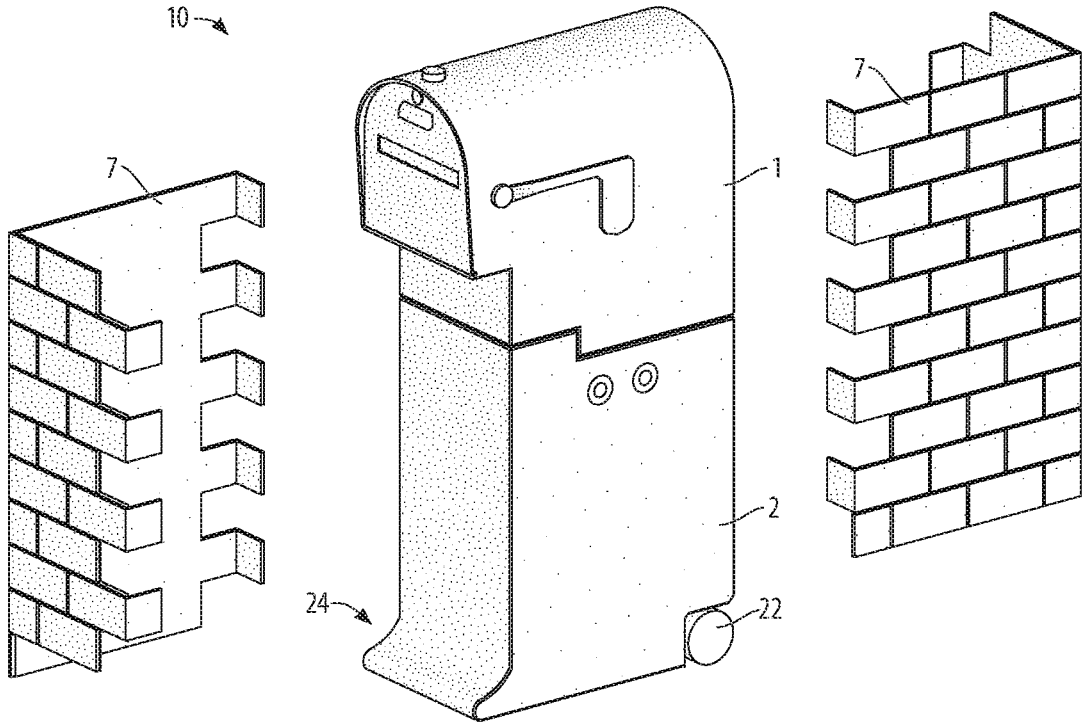
FIG. 9 is a schematic view of an ornamental-casing embodiment of the portable secure mailbox system of the invention.
Figure 10:
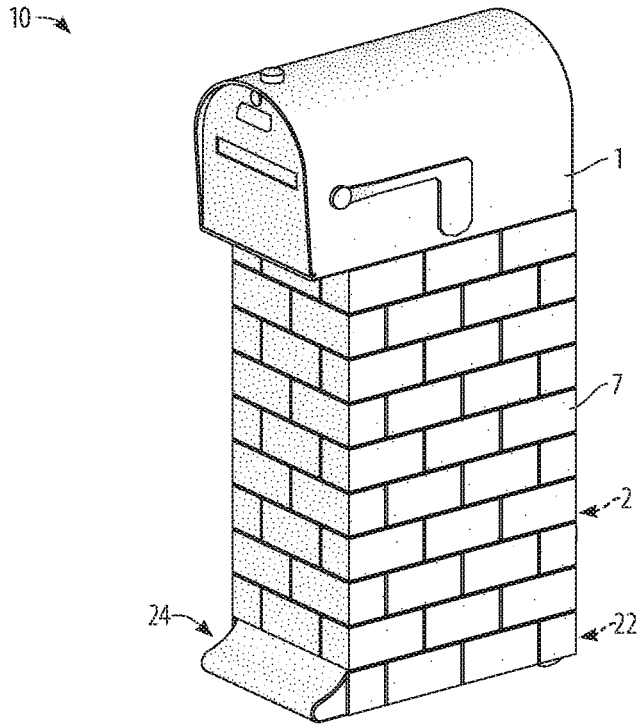
FIG. 10 is a dimetric-projection view of an ornamental-casing embodiment of the portable secure mailbox system of the invention.

Referring to FIG. 9 and FIG. 10, an embodiment of the portable secure mailbox system 10 provides an ornamental casing 7 covering the base anchor unit 2 and part of the mail container unit 1, providing additional stability and a different appearance. The ornamental casing can be made to emulate bricks, as shown, or stone, wood, concrete, and other materials.

The portable secure mailbox system 10 provides a mailbox and support base that can be easily transported and put in place when empty. No digging or concrete work is required. After the base anchor unit is filled with anchoring material such as water or sand, and the mail container unit is mounted upon the base anchor unit, the portable secure mailbox system 10 provides a stable secure mailbox that can detect activity and transmit notifications.

The portable secure mailbox system 10 is particularly useful in situations such as the setting up, taking down, and moving of temporary buildings, such as a temporary encampment.

The portable secure mailbox system 10 also provides a mailbox and support base that yield somewhat if struck by a vehicle, analogous to water or sand filled highway barriers. The portable secure mailbox system 10 should remain functional and only require being put back in place, and damage to the vehicle and driver is reduced.

Many other changes and modifications can be made in the present invention without departing from the spirit thereof. I therefore pray that my rights to the present invention be limited only by the scope of the appended claims.

I claim:

1. A portable secure mailbox system for installation on a mailbox site, having up and down, front and back orientation, the portable secure mailbox system comprising:

(i) a mail container unit adapted to contain mail within an interior void area, said mail container unit comprising:
  (a) a container-unit protrusion on a lower portion of said mail container unit, adapted to provide a means for secure mounting, having at least one side-to-side opening;
  (b) a container-unit door at a front of said mail container unit, adapted to provide secure closure; and
  (c) a container-unit partition adapted to segregate a portion of the interior void area of said mail container unit;

(ii) a base anchor unit adapted to contain an anchoring material within an interior void area, and having at least one side-to-side opening corresponding to said container-unit protrusion, said base anchor unit comprising:
  (a) a base-unit recess at an upper portion of said base anchor unit, corresponding to said container-unit protrusion, adapted to enclose said container-unit protrusion;
  (b) a set of base-unit wheels at a back lower portion of said base anchor unit, adapted to provide for rolling of said base anchor unit when tilted back;
  (c) a base-unit removable plug at a top portion of said base anchor unit, adapted to provide for filling and emptying said base anchor unit with an anchoring material; and
  (d) a base-unit foot at a front lower portion of said base anchor unit, adapted to provide additional stability and to discourage too close an approach to said mail container unit;

(iii) at least one bolt adapted to provide attachment through the aligned side-to-side openings of said container-unit protrusion and said base anchor unit;

(iv) at least one nut adapted to secure each said bolt; and (v) a powered sensor-transmitter unit adapted to detect movement within said mail container unit, and to transmit wireless notifications about the status of said mail container unit;

where, in use, said portable secure mailbox system is installed by transporting said mail container unit and said based anchor unit to the mailbox site as separate units, filling said base anchor unit with said anchoring material, placing said container-unit protrusion into said base-unit recess and securing with said bolts and nuts, and activating said powered sensor-transmitter unit.

2. The portable secure mailbox system of claim 1, where the anchoring material is a fluid.

3. The portable secure mailbox system of claim 1, where the anchoring material is water.

4. The portable secure mailbox system of claim 1, where the anchoring material is a granular material.

5. The portable secure mailbox system of claim 1, where the anchoring material is sand.

6. The portable secure mailbox system of claim 1, where the anchoring material is gravel.

7. The portable secure mailbox system of claim 1, where said mail container unit is made from a plastic material.

8. The portable secure mailbox system of claim 1, where said mail container unit is made from polypropylene.

9. The portable secure mailbox system of claim 1, where said base anchor unit is made from a plastic material.

10. The portable secure mailbox system of claim 1, where said base anchor unit is made from polypropylene.

11. The portable secure mailbox system of claim 1, further comprising a solar array mounted upon said mail container unit, adapted to use solar power to keep said powered sensor-transmitter unit charged.

12. The portable secure mailbox system of claim 1, further comprising an ornamental casing adapted to cover said base anchor unit.

13. A portable secure mailbox system for installation on a mailbox site, having up and down, front and back orientation, the portable secure mailbox system comprising:

(i) a mail container unit adapted to contain mail within an interior void area, said mail container unit comprising:
  (a) a container-unit protrusion on a lower portion of said mail container unit, adapted to provide a means for secure mounting, having at least one side-to-side opening;
  (b) a container-unit door at a front of said mail container unit, adapted to provide secure closure; and
  (c) a container-unit partition adapted to segregate a portion of the interior void area of said mail container unit;

(ii) a base anchor unit adapted to contain an anchoring material within an interior void area, and having at least one side-to-side opening corresponding to said container-unit protrusion, said base anchor unit comprising:
  (a) a base-unit recess at an upper portion of said base anchor unit, corresponding to said container-unit protrusion, adapted to enclose said container-unit protrusion;
  (b) a set of base-unit wheels at a back lower portion of said base anchor unit, adapted to provide for rolling of said base anchor unit when tilted back;
  (c) a base-unit removable plug at a top portion of said base anchor unit, adapted to provide for filling and emptying said base anchor unit with an anchoring material; and
  (d) a base-unit foot at a front lower portion of said base anchor unit, adapted to provide additional stability and to discourage too close an approach to said mail container unit;

(iii) at least one bolt adapted to provide attachment through the aligned side-to-side openings of said container-unit protrusion and said base anchor unit;

(iv) at least one nut adapted to secure each said bolt;

(v) a powered sensor-transmitter unit adapted to detect movement within said mail container unit, and to transmit wireless notifications about the status of said mail container unit;

(vi) a solar array mounted upon said mail container unit, adapted to use solar power to keep said powered sensor-transmitter unit charged; and (vii) an ornamental casing adapted to cover said base anchor unit;

where, in use, said portable secure mailbox system is installed by transporting said mail container unit and said based anchor unit to the mailbox site as separate units, filling said base anchor unit with said anchoring material, placing said container-unit protrusion into said base-unit recess and securing with said bolts and nuts, and activating said powered sensor-transmitter unit.

14. The portable secure mailbox system of claim 13, where the anchoring material is a fluid.

15. The portable secure mailbox system of claim 13, where the anchoring material is water.

16. The portable secure mailbox system of claim 13, where the anchoring material is a granular material.

17. The portable secure mailbox system of claim 13, where the anchoring material is sand.

18. The portable secure mailbox system of claim 13, where the anchoring material is gravel.

19. The portable secure mailbox system of claim 13, where said mail container unit and said base anchor unit are made from a plastic material.

20. The portable secure mailbox system of claim 13, where said mail container unit and said base anchor unit are made from polypropylene.

* * * * *